US011253764B2

(12) United States Patent
Klanow et al.

(10) Patent No.: US 11,253,764 B2
(45) **Date of Patent: *Feb. 22, 2022**

(54) REBOUND DEVICE TO FACILITATE HOCKEY TRAINING

(71) Applicant: GIVE-N-GO HOCKEY, Northville, MI (US)

(72) Inventors: Brian Klanow, Holly, MI (US); James P. Marinoff, Northville, MI (US)

(73) Assignee: GIVE-N-GO HOCKEY, Northville, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/985,297

(22) Filed: Aug. 5, 2020

(65) Prior Publication Data

US 2020/0360788 A1 Nov. 19, 2020

Related U.S. Application Data

(63) Continuation of application No. 14/828,660, filed on Aug. 18, 2015, now Pat. No. 10,737,163.

(51) Int. Cl.
*A63B 69/00* (2006.01)
*A63B 71/02* (2006.01)

(52) U.S. Cl.
CPC ..... *A63B 69/0097* (2013.01); *A63B 69/0024* (2013.01); *A63B 2071/024* (2013.01); *A63B 2208/0204* (2013.01)

(58) Field of Classification Search
CPC ..... A63B 69/0097; A63B 69/0024; A63B 2071/024; A63B 2208/0204
USPC ..... 473/435
See application file for complete search history.

(56) References Cited

U.S. PATENT DOCUMENTS 4,351,525 A 9/1982 Rozenblad
4,373,720 A 2/1983 Lombardi et al.
4,417,728 A 11/1983 Hay et al.
4,886,274 A 12/1989 Park
5,161,799 A 11/1992 Nandra
(Continued)

FOREIGN PATENT DOCUMENTS

FR 2738750 A1 * 3/1997 ..... A63B 69/0026
FR 2738750 A1 3/1997
(Continued)

OTHER PUBLICATIONS

Canadian Office Action for Application No. 2,900,802 dated Oct. 26, 2021.

*Primary Examiner* — Alvin A Hunter
*Assistant Examiner* — Rayshun K Peng
(74) *Attorney, Agent, or Firm* — Carlson, Gaskey & Olds, P.C.

(57) ABSTRACT

An illustrative example embodiment of an ice hockey puck rebounder includes a rigid base with ends and side faces. At least one resilient member has a first surface secured to at least one of the side faces. A first surface of the resilient member is received against and supported by the side face of the base along its entire length. The resilient member comprises a rubber material having a durometer between 50 and 60. A second, outwardly facing surface of the resilient member presents a rebound surface for being contacted by an ice hockey puck. The resilient member consistently, resiliently deflects an ice hockey puck away from the resilient member.

16 Claims, 3 Drawing Sheets

(56) References Cited

U.S. PATENT DOCUMENTS

| | | | |
|---|---|---|---|
| 5,249,797 | A | 10/1993 | Dowhy |
| 5,362,045 | A | 11/1994 | Hammett et al. |
| 5,382,022 | A | 1/1995 | Cook et al. |
| 5,531,449 | A | 7/1996 | Denton |
| 5,580,048 | A | 12/1996 | Mullen et al. |
| 5,951,414 | A | 9/1999 | Sowards |
| 6,248,022 | B1 | 6/2001 | Steyn |
| 6,328,664 | B1 | 12/2001 | Hammett |
| D513,774 | S | 1/2006 | Nudo |
| 7,074,140 | B1 | 7/2006 | McNary |
| D533,247 | S | 12/2006 | Weeks |
| 7,534,176 | B1 | 5/2009 | McNary |
| 7,578,757 | B1 | 8/2009 | McNary |
| D628,253 | S | 11/2010 | McKinney et al. |
| D674,032 | S | 1/2013 | Howard, II |
| 8,357,061 | B2 | 1/2013 | Quinn |
| 8,469,841 | B1 | 6/2013 | Giauque et al. |
| 2002/0151386 | A1 | 10/2002 | Williams |
| 2004/0142775 | A1 | 7/2004 | Nudo |
| 2005/0192125 | A1* | 9/2005 | Valliquette ..... A63B 69/0097 473/446 |
| 2006/0063615 | A1 | 3/2006 | Richardson et al. |
| 2006/0142099 | A1 | 6/2006 | Trucks |
| 2010/0022333 | A1* | 1/2010 | Gaudin ..... A63B 69/0097 473/478 |
| 2010/0248868 | A1 | 9/2010 | Massaro |
| 2011/0200816 | A1* | 8/2011 | Mizrahi ..... B32B 27/365 428/328 |
| 2012/0157242 | A1 | 6/2012 | Quinn |
| 2013/0344996 | A1 | 12/2013 | Adema |
| 2015/0297967 | A1 | 10/2015 | Simon |
| 2016/0045803 | A1 | 2/2016 | Klanow et al. |

FOREIGN PATENT DOCUMENTS

| | | | |
|---|---|---|---|
| GB | 2292690 | A | 3/1996 |
| GB | 2533780 | A | 7/2016 |

* cited by examiner

REBOUND DEVICE TO FACILITATE HOCKEY TRAINING

CROSS-REFERENCE TO RELATED APPLICATION

This application is a continuation of U.S. application Ser. No. 14/828,660, which was filed on Aug. 18, 2015, and issued as U.S. Pat. No. 10,737,163 on Aug. 11, 2020.

BACKGROUND

A variety of sports training devices have been developed to enhance athlete performance. Many sports require specific skills and abilities and a variety of training devices have been used to facilitate drills and practice exercises that facilitate developing such skills and abilities.

The game of hockey requires accurate passing between players. It is useful for a player to develop the ability to deliver accurate passes and to competently handle passes provided to that player. One type of device that has been proposed to facilitate passing drills includes rubber band-like straps supported at two ends to provide a spring-like surface against which a hockey puck may be directed and subsequently received from.

While these devices may be of some use, they suffer from various drawbacks and limitations. For example, the rubber band-like straps typically do not mimic the behavior of a passed puck during real game situations. Additionally, there tends to be a limited area where the puck needs to impact the strap or the rebounding effect is significantly different. For example, near the ends of the strap much less of a rebound effect occurs compared to when the puck impacts the center of the strap. This difference in rebound behavior can be annoying and hinder the progress of passing drills.

Another skill that is required in the game of hockey is for a goaltender to be able to react to puck deflections and so-called one-timer shots immediately after the puck has been passed between opposing players. When players are not available for conducting such drills for a goaltender, goaltending coaches have tried to use the dasher boards as a surface against which to deflect the puck toward the goaltender in a fashion that mimics a deflection or one-timer shot during a game situation. The rigid dasher board provides a surface from which the puck can rebound but the behavior does not simulate real game conditions.

SUMMARY

An illustrative example embodiment of an ice hockey puck rebounder includes a rigid base with ends that establish a base width. The rigid base includes side faces between the ends that establish a base length that is greater than the width. The side faces of the base have a height that is less than the length. At least one resilient member has a first surface secured to at least one of the side faces of the base. The resilient member has a thickness in a direction parallel to the base width between the first surface and a second surface facing in an opposite direction from the first surface. The resilient member is received against and supported by the side face of the base along its entire length. The resilient member has a durometer between 50 and 60. The second surface presents a rebound surface for being contacted by an ice hockey puck. The resilient member consistently, resiliently deflects an ice hockey puck away from the resilient member.

An illustrative example method of making a rebound device includes establishing a base. The base is powder coated and then some of the coating on at least a portion of at least one side face is roughened. An adhesive enhancer is applied to the roughened portion. The applied enhancer is then roughened to disrupt the outer layer or surface of the adhesive enhancer. An adhesive is then applied to at least one of the roughened portion or the resilient member. The resilient member is then secured to the roughened portion of the base by the adhesive.

The various features and advantages of at least one disclosed embodiment will become apparent to those skilled in the art from the following detailed description. The drawings that accompany the detailed description can be briefly described as follows.

DETAILED DESCRIPTION

Figure 1:
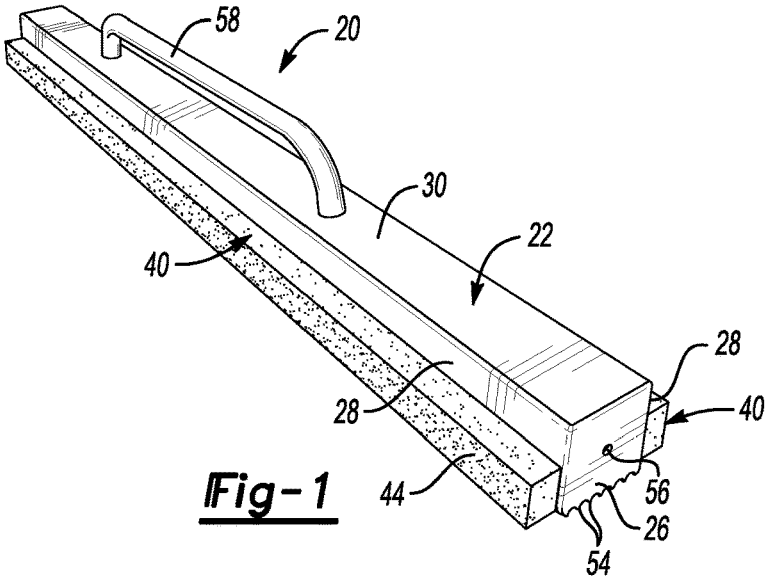
FIG. 1 is a perspective illustration of a rebound device designed according to an embodiment of this invention.
Figure 2:
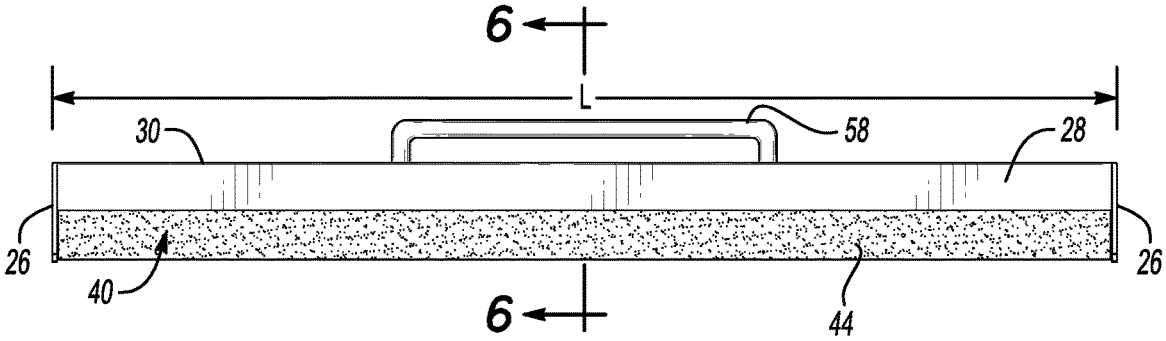
FIG. 2 is a side, elevational view of the device shown in FIG. 1.
Figure 3:
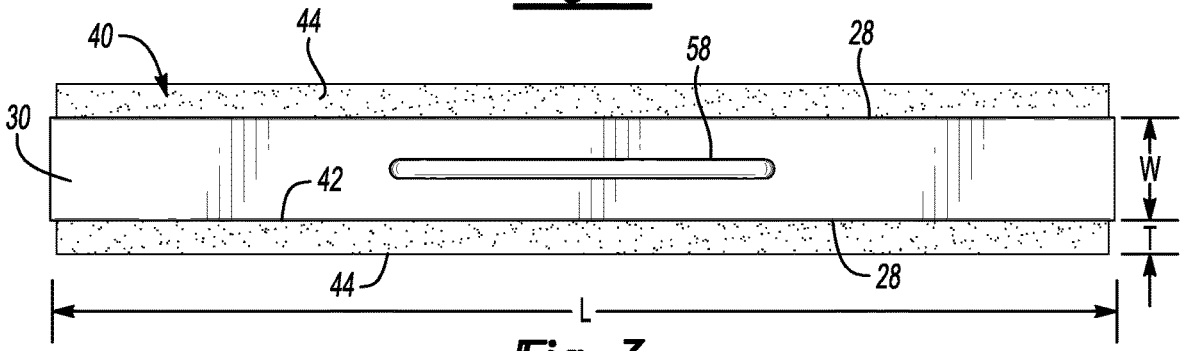
FIG. 3 is a top elevational view of the device of FIG. 1.
Figure 4:
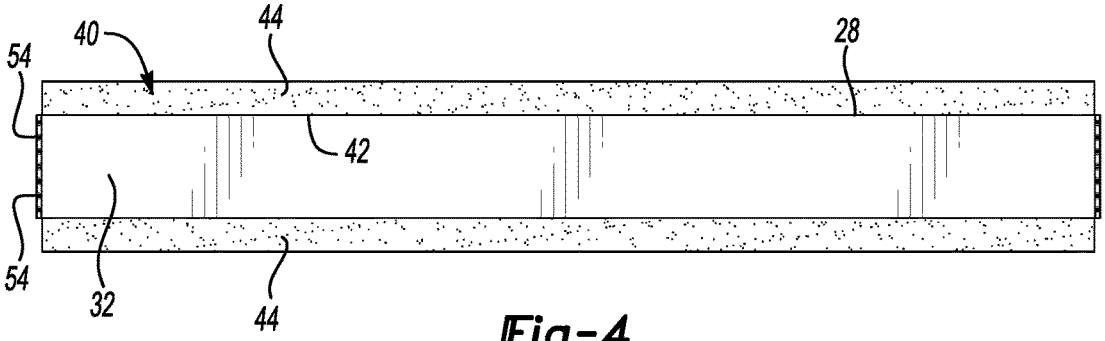
FIG. 4 is a bottom elevational view of the device of FIG. 1.
Figure 5:
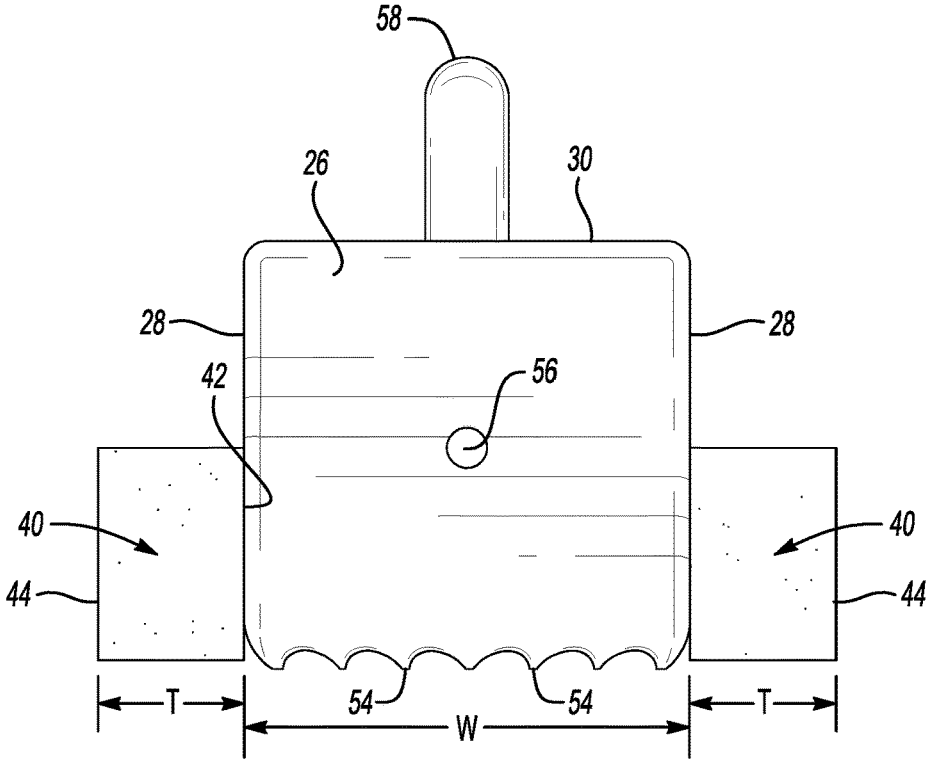
FIG. 5 is an end view of the device of FIG. 1.

FIG. 1 shows a rebound device 20 designed according to an embodiment of this invention and that is useful as a practice or training aid for hockey. The rebound device 20 includes a rigid base 22 that is made of metal. In this example, the base 22 comprises a steel tube having a rectangular cross-section as can be appreciated in FIG. 6. The base 22 includes end faces 26 that establish or define a width W as can best be appreciated in FIGS. 5 and 6. Side faces 28 extend between the end faces 26. The side faces 28 establish or define a length L of the device 20 as can best be appreciated from FIGS. 2-4. A top face 30 and a bottom face 32 (FIG. 4) have the same length L in this example. The length L is greater than the width W.

The device 20 includes at least one resilient member 40 that is secured to a side face 28 of the base 22. The illustrated example includes a resilient member 40 on each of the side faces 28. The resilient members 40 have a thickness T in a direction parallel to the width W as visible in FIGS. 5 and 6. The thickness T is less than the width W in this example embodiment. A first side 42 of the resilient members faces toward and is secured to a corresponding side face 28 of the base 22. A second side 44 of the resilient member faces in an opposite direction from the first side 42. The thickness T is a dimension between the first side 42 and the second side 44.

Figure 7:
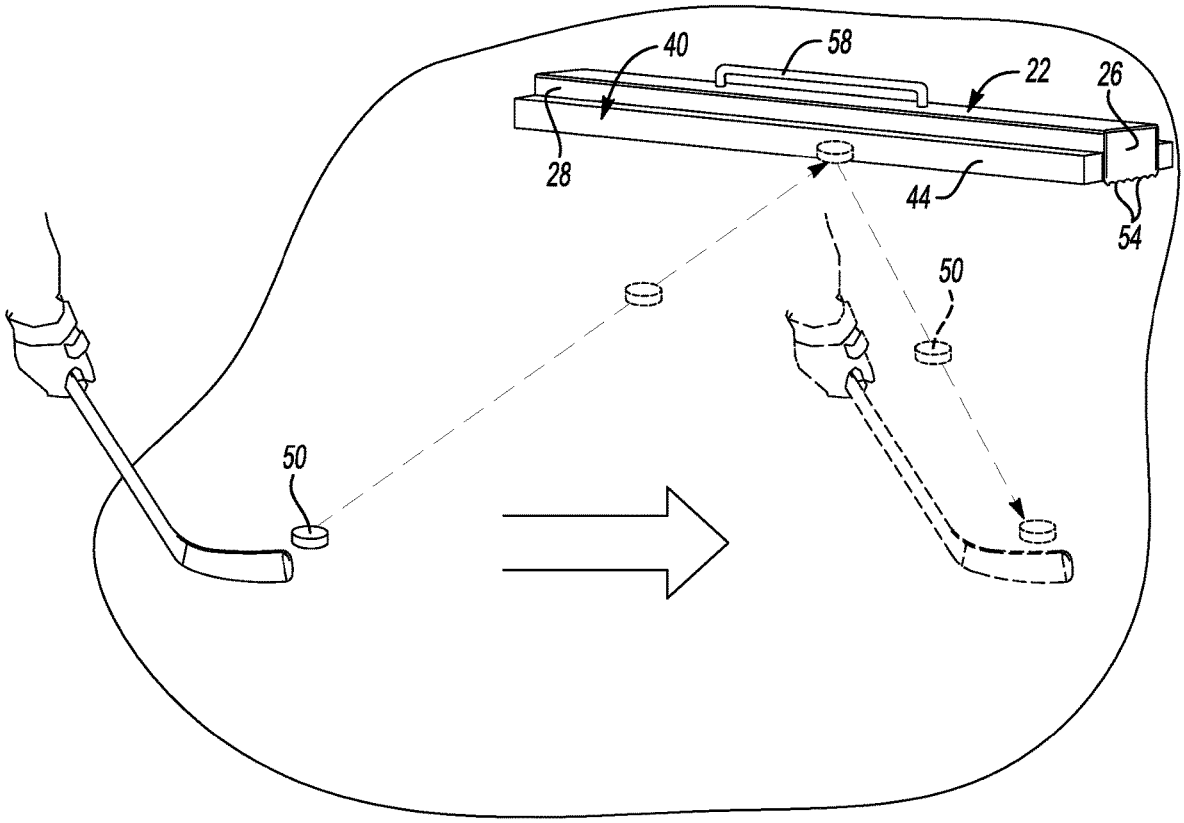
FIG. 7 schematically illustrates an example use of the device of FIG. 1.

The second side 44 presents a rebound surface for resiliently deflecting an object away from the device 20. FIG. 7 schematically illustrates an example use of the device 20 for a hockey training drill in which a player directs a hockey puck 50 toward the second side 44 of a resilient member 40. After the puck rebounds off the resilient member 40, the same player (or another player) receives the puck 50. The schematically illustrated drill may be a part of a passing drill or a training session that includes simulating a "give and go" passing situation during a hockey game.

As can be appreciated from FIGS. 1-4, the resilient members 40 have a length that corresponds to the length L of the base. The resilient member 40 is secured to and supported by the side face 28 of the base 22 along the entire length of the resilient member 40 in the illustrated example. This feature provides a solid backing to the entire resilient member and provides a stable, consistent placement of the resilient member in a selected position on the ice or floor surface. Having the entire length of the resilient member supported in this way ensures a consistent amount of snap back effect when a puck (or another object) strikes and rebounds from the second side 44 of the resilient member 40 regardless of where the puck contacts the resilient member 40. This feature of the illustrated example is a significant improvement over devices that rely upon rubber bands or straps for deflecting or rebounding a puck as such devices cannot provide a consistent or reliable rebound effect.

The resilient members 40 in the illustrated embodiment comprise a rubber-based material. Natural rubber or gum rubber is used for some embodiments. A durometer of approximately 55 provides a desirable rebound effect. Durometers between 48 and 60 are useful. Depending on the selected material, a resilient member 40 having a durometer of 45 or less may be too soft and may not provide a sufficient snap-back effect when a puck rebounds off the resilient member. Additionally, a softer resilient member may tend to break down too quickly especially with regular or continuous use. A durometer over 60 tends to leave the resilient members 40 too rigid so that a desired rebound effect is not easily or consistently achieved. In an example embodiment, the material chosen for the resilient members comprises a commercially available rubber having a 55 durometer rating. Some commercially available rubber materials having a 55 durometer rating tend to have an actual durometer between 50 and 60.

Figure 6:
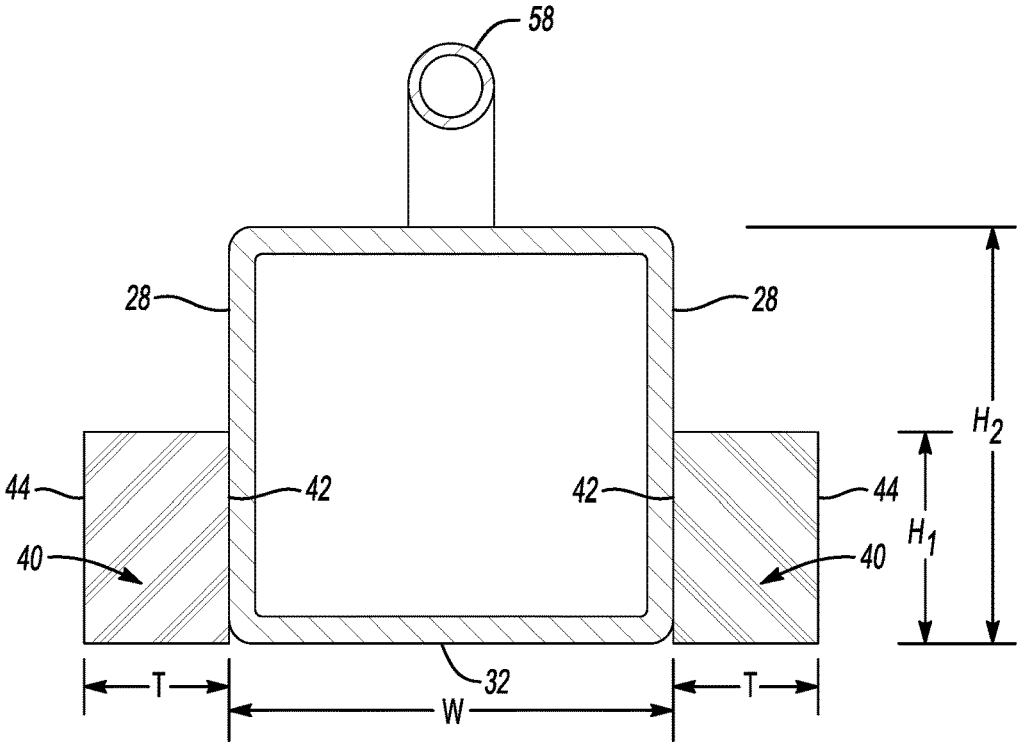
FIG. 6 is a cross-sectional view taken along the lines 6-6 in FIG. 2.

The resilient members 40 also have a first height H1 that is less than a second height H2 of the side faces 28 as shown in FIG. 6. In one example embodiment, the width W and second height H2 of the base 22 are four inches, the thickness T is one-and-one-half inches and the first height H1 is two inches. In some examples, the length L is sixty inches and in others the length L is thirty or thirty-six inches. Longer length devices are typically useful for teams or facility use while shorter lengths tend to be useful for individual consumer or home-based training.

One feature of the illustrated embodiment is that the end faces 26 include a plurality of teeth 54 that resist movement of the base 22 relative to the ice surface upon which the device 20 is placed. The teeth 54 in this example include some oriented at a first oblique angle relative to the width dimension of the base 22 and others at a second, different oblique angle relative to the width dimension. Differently oriented teeth facilitate a stable placement of the device 20 on the ice. The teeth 54 and the mass of the device 20 are effective at keeping the device 20 in a desired position and orientation on the ice throughout most drills for many different skill levels of play.

Another embodiment does not include teeth on the underside of the base 22. Instead, a plurality of rubber or polymer pads are secured to the bottom 32 of the base 22. The pads resist movement of the device along a floor surface to maintain a desired placement of the device 20. Such pads can also protect a floor surface against damage that otherwise might result from contact with the metal base 22.

Another feature of the example embodiment is that the end faces 26 each include at least one opening 56 (best seen in FIGS. 1 and 5) that allows for ventilation of the interior of the device 20. The openings 56 prevent a build up of condensation within the device 20 and prevent corrosion by allowing for evaporation of any moisture from within the base 22. This feature tends to increase the durability and longevity of the device.

The illustrated device 20 also includes a handle 58 that is secured to the top face 30. The handle 58 facilitates carrying the device 20 to a desired location and placing it in a selected orientation on the ice.

Figure 8:
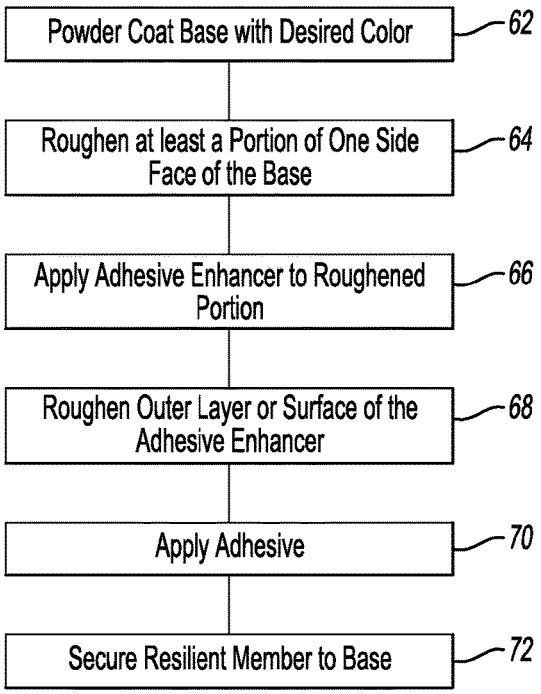
FIG. 8 is a flowchart diagram summarizing an example approach for making a rebound device designed according to an embodiment of this invention.

FIG. 8 is a flowchart diagram 60 summarizing an example method of making a rebound device, such as the illustrated example embodiment. At 62, the base 22 is powder coated with a coating having a desired color. Powder coatings are useful to maintain a desired appearance of the device and to avoid corrosion of the metal of the device 20. At 64, at least a portion of the powder coating on at least one of the side faces is roughened using an abrasive tool or pad, such as sandpaper. The roughening prepares an area on the side face where a resilient member 40 will be secured. If both side faces 28 will support a resilient member 40, then at least a lower portion of both side faces 28 is roughened at 64.

An adhesive enhancer is applied to the roughened portion(s) at 66. After the adhesive enhancer is applied, it is roughened at 68 to at least slightly roughen the outer layer or outer surface of the enhancer without removing all of the enhancer. At 70, adhesive is applied to at least one of the prepared portion of the side face(s) 28 and the first side(s) 42 of a resilient member 40. The final step represented at 72 in FIG. 8 includes adhesively securing the resilient member(s) 40 to the side face(s) 28 by pressing or holding the resilient member(s) 40 against the side face(s) 28 until the adhesive is cured.

The adhesive in one example embodiment comprises a urethane two-part epoxy adhesive. One such adhesive is known as Lord 7542 Urethane Adhesive and is commercially available from Lord Corporation. The adhesive enhancer in one example is a pretreat rubber adhesive enhancer available from Lord Corporation.

The preceding description is exemplary rather than limiting in nature. Variations and modifications to the disclosed example may become apparent to those skilled in the art that do not necessarily depart from the essence of this invention. The scope of legal protection given to this invention can only be determined by studying the following claims.

We claim:

1. An ice hockey puck rebound device, comprising:

a rigid base including ends that establish a base width, the rigid base including side faces between the ends, the side faces establishing a base length that is greater than the width, the side faces of the base having a height that is less than the length; and at least one resilient member having a first surface secured to at least one of the side faces of the base, the resilient member has a thickness in a direction parallel to the base width between the first surface and a second surface facing in an opposite direction from the first surface, the resilient member being received against and supported by the side face of the base along an entire length of the resilient member, the resilient member having a durometer between 50 and 60, the second surface presenting a rebound surface for being contacted by an ice hockey puck, the resilient member consistently resiliently deflecting the ice hockey puck away from the resilient member.

2. The ice hockey puck rebound device of claim 1, wherein the durometer is 55.

3. The ice hockey puck rebound device of claim 1, wherein the thickness of the resilient member is at least one-third the base width.

4. The ice hockey puck rebound device of claim 1, comprising a second resilient member on another side of the base that faces in an opposite direction from the one side face.

5. The ice hockey puck rebound device of claim 1, wherein the resilient member length is equal to the length of the at least one of the side faces; and the resilient member thickness is less than the base width.

6. The ice hockey puck rebound device of claim 1, wherein the side faces of the base have a height and the resilient member has a height that is less than the height of the side faces.

7. The ice hockey puck rebound device of claim 6, wherein the resilient member has a thickness that is less than the height of the resilient member.

8. The ice hockey puck rebound device of claim 7, wherein the resilient member thickness is about 1.5 inches.

9. The ice hockey puck rebound device of claim 1, wherein the resilient member is adhesively secured to the at least one side face.

10. The ice hockey puck rebound device of claim 1, comprising a handle along a portion of the base length.

11. The ice hockey puck rebound device of claim 1, wherein the base comprises powder coated steel.

12. The ice hockey puck rebound device of claim 1, wherein the base length is between about seven times and fifteen larger than the base width.

13. The rebound device of claim 1, wherein the ends are enclosed.

14. The rebound device of claim 1, wherein the base includes a plurality of teeth projecting from a bottom of the base.

15. The rebound device of claim 1, wherein the resilient member comprises a rubber material.

16. The rebound device of claim 1, wherein the resilient member is a rubber bumper having a rectangular cross-section.

* * * * *